United States Patent [19]

Lücke et al.

[11] Patent Number: 4,674,887

[45] Date of Patent: Jun. 23, 1987

[54] METHOD OF MIXING PARTICULATE MATERIALS

[75] Inventors: Roland Lücke, Paderborn; Bernhard Balkenhol, Düsseldorf, both of Fed. Rep. of Germany

[73] Assignee: Gebr. Lodige Maschinenbau Gesellschaft mbH, Paderborn, Fed. Rep. of Germany

[21] Appl. No.: 852,074

[22] Filed: Apr. 14, 1986

[30] Foreign Application Priority Data

Dec. 9, 1983 [DE] Fed. Rep. of Germany ..... 3344531

[51] Int. Cl.[4] ..... B01F 3/18; B01F 7/04

[52] U.S. Cl. ..... 366/325; 366/348

[58] Field of Search ..... 366/276, 278, 279, 312, 366/313, 325, 343, 348

[56] References Cited

U.S. PATENT DOCUMENTS 563,222 6/1896 Class ..... 366/325 X
4,214,376 7/1980 Lucke et al. ..... 366/313 X
4,305,673 12/1981 Herbst ..... 366/343
4,421,414 12/1983 Holupko ..... 366/348

*Primary Examiner*—Philip R. Coe
*Attorney, Agent, or Firm*—Merchant, Gould, Smith, Edell, Welter & Schmidt

[57] ABSTRACT

Mixing apparatus has a mixing container and a mixing device mounted in it, comprising a driven shaft connected to a driving motor and extending through the container along its longitudinal axis and mounted rotatably, and radially extending arms mounted on this shaft and having at their outer ends respective mixing tools moving around close to the wall of the container. Each tool is provided both on its leading and also on its rear end with at least one working flank extending at an angle to the plane of rotation of the tool. The working flank at the one end of each tool extends at a different angle of inclination to the plane of rotation of the tool from that at the other end. The shaft of the tool is driven with a reversible direction of rotation.

1 Claim, 4 Drawing Figures

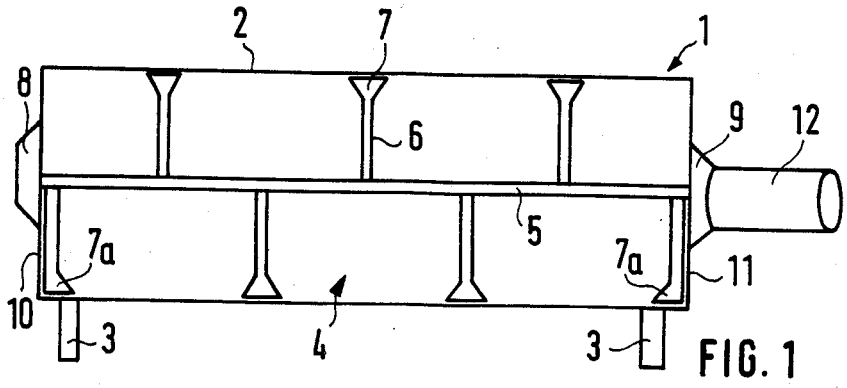
FIG. 1
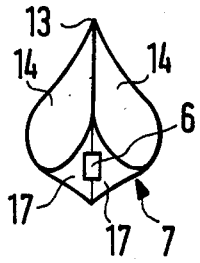
FIG. 4
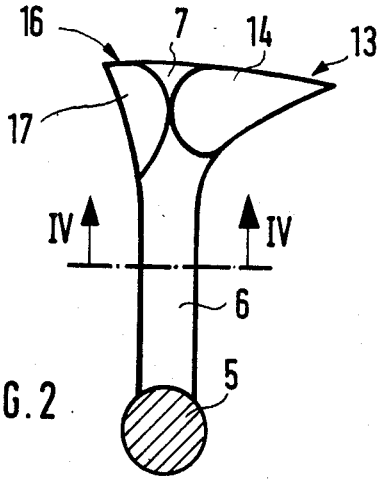
FIG. 2
FIG. 3
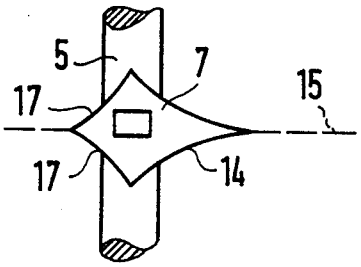

METHOD OF MIXING PARTICULATE MATERIALS

This is a continuation of application Ser. No. 679,319 filed Dec. 7, 1984, now abandoned.

The invention relates to a method of mixing particulate materials with mixing apparatus having a mixing container and a mixing device mounted within it comprising a shaft connected to a driving motor and extending through the container along its longitudinal axis and rotatable mounted, and radially extending arms mounted on the shaft, the outer ends of the arms carrying a respective mixing tool which moves around close to the wall of the container when the mixing device rotates.

The mixing effect or mixing ability of such mixing apparatus depends not insignificantly on the shape or form of the mixing tools. Accoringly, for the various materials to be mixed and different mixing problems one uses tools of different shapes. Where the mixing apparatus is always to be employed for the same kind of materials, mixing tools which are designed for the particular problem provide satisfactory results. However, where different materials are to be handled in the mixing apparatus, which is often the case in small plants having frequently changing mixing problems, one has to change the mixing tools if one wants to achieve optimum results.

The invention is based on solving the problem of providing mixing apparatus which is suitable for handling different materials to be mixed, but with optimum efficiency, without it being necessary to modify the apparatus when changing from one material to another.

This problem is solved, according to the invention, in mixing apparatus of the kind stated in the introduction, in that each mixing tool has on both its front and its rear end at least one working flank extending at an angle to the plane of rotation of the tool, the working flanks on the one end of the tool extending at a different angle of inclination to the plane of rotation of the tool from those at the other ends, and that the shaft of the mixing device is driven with a reversible direction of rotation.

The mixing apparatus according to the invention combines, so to say, two mixers in one since, by simply reversing the direction of rotation of the mixing device, one is in a position to work with two more or less differently shaped types of mixing tools, and accordingly to handle widely differing loose materials one after another.

It has been found that materials are treated with optimum efficiency in a mixer and laterally delivered, when the working flanks of the tools which act on the material have a profile and are at an angle to the plane of rotation of the tool which correspond approximately to the internal fracture lines of the materials to be mixed or shaken. As the internal fracture lines extend differently in the different materials to be mixed it is not possible to develop a mixing tool which is optimally suited to all materials. However, by means of the present invention there is provided a mixing apparatus which can brings into action a mixing tool which is at least approximately suited to a very large number of different materials, since it is sufficient if the respective working flanks of the tool which are effective corresponding approximately to the internal fracture lines of the respective material which is to be handled.

To determine the internal fracture lines of a given material a flat surface is forced perpendicularly through the material so that in front of it there builds a heap of material which the surface displaces ahead of it. This heap of material takes up the shape of a cone determined by the internal friction of the material, i.e. by the friction of the particles of the material between one another, and its defining surface displays the fracture line which is sought. The internal fracture lines can be determined experimentally for various materials. They are similar for many materials so that for a large proportion of mixing problems wedge-shaped or ploughshare-like mixing tools of the same profile can be employed. Basic differences in the internal fracture lines result when the basic consistency of the materials alters. Dry materials, capable of being poured, display different internal fracture lines from damp and/or sticky materials.

By means of the mixing apparatus according to the invention both dry pourable materials and also damp or even sticky materials can be handled for mixing with optimum efficiency.

Preferably the driving motor for the shaft of the mixing apparatus according to the invention is a motor having a reversible direction of rotation, but it is also possible to provide a reversing gear between the shaft of the mixer and the driving motor. In this way, simply by reversing the direction of rotation, whether it be of the motor or of the reversing gear, one is in a position to set the desired direction of rotation of the shaft and thereby to bring into action the working flanks of the tool suited to the particular problem that arises.

According to a preferred practical embodiment of the invention the working flanks at the one end of the tool are arranged at an acute angle and at the other end they are at a less acute angle to the plane of rotation of the respective tool, so that, according to the direction of rotation, the tools have as far as possible a "slim" shape or a "blunt" shape and accordingly dip into the material to be treated like a sharp wedge or an obtuse angled tool. The blunter working flanks can be at a coarse angle, i.e. an angle greater than 45° to the plane of rotation of the respective tool, but angles of 45° and smaller are possible.

Advantageously the working flanks of the tools are concavely curved so that a ploughshare-like shape results, and indeed this applies both to the working flanks arranged at an acute angle and also those at a . coarser angle.

Two working flanks are advantageously provided on each end of the tool, bearing a mirror image relationship to one another and lying on opposite sides of the tool, so that the mixing tools are, so to speak, double-sided ploughshare-like tools. It is however also possible to provide the working flanks only on one side of the tools, as is sensible in particular in the region of the end of the cylindrical container, but it can also be of advantage in the central region of the container.

An embodiment of a mixing apparatus according to the invention is illustrated diagrammatically in the drawing by way of example. In the drawing:

FIG. 1 is a side view of the overall mixing apparatus,

FIG. 2 is a side view of a mixing tool formed in accordance with the invention;

FIG. 3 is a plan view of the base of this tool and

FIG. 4 is a section on the line IV—IV in FIG. 2.

The mixing apparatus 1 has a drum-shaped or cylindrical mixing container 2 supported on feet 3.

Mounted in the container 2 is a mixing device 4 comprising a shaft 5 arranged co-axially with the container 2 and having mixing tools 7 secured to radial arms 6, the tools lying close to the inner wall of the container 2 and moving round close to this wall when the shaft 5 is rotated.

The shaft 5 is mounted to rotate in bearings 8 and 9 at its two ends, in the end walls 10 and 11 of the container 2. Mounted outside the bearing 9 is a driving motor 12 for the shaft 5, capable of being operated with a reversible direction of rotation, so that, according to the direction selected, the shaft 5 can be driven in one direction of rotation or the other. To reverse the direction of rotation of the motor 12 it is only necessary to operate a switch, not shown.

As shown in FIG. 2 to 4 the mixing tools 7 have a different shape at their two ends. At the one end 13 they are made relatively slim and provided with concavely curved lateral working flanks 14 which extend in a mirror-image relationship at an acute angle to the plane of rotation 15 of the tool 7, on opposite sides of this plane, as shown in particular in FIG. 3.

At the other end 16 there are likewise working flanks 17 arranged in a mirror-image relationship at the sides of the plane 15 of rotation, but they are at a much less acute angle to the plane 15 of rotation, as can be seen in particular in FIG. 3. Again the working flanks 17 are concavely curved.

According to whether one wants to act on the materials present in the container 2 with the steep or coarse-angled working flanks 17, or with the acutely angled working flanks 14, one switches on the driving motor 12 so that the shaft 5 rotates, as viewed in FIG. 2, either to the left or to the right. By simple reversal of the direction of rotation of the shaft 5 the very differently shaped ends 16 or 13 of the tools 7 can be brought into action as working ends.

It can be seen from FIG. 1 that so-called halftools *7a* are arranged at the ends 10 and 11 of the container 2, that is to say, mixing tools which only have working flanks 14 and 17 on one side, namely on the side which is towards the interior of the container 2. It is, however, also possible to arrange such halftools *7a* in the central region of the container 2 and accordingly to provide them distributed throughout the length of the shaft 5.

in operation, a first particulate material is placed in the container 2. The first particulate material has a given internal fracture line. The shaft 5 is rotated in a first direction to mix the first particulate matter by contact with one of the ends 13 or 16. The first particulate material is then removed from the mixing container 2 and a second particulate material is placed in the mixing container 2. The second particulate material has a different internal fracture line from that of the first particulate material. The shaft 5 is then rotated in a second direction, opposite from the first direction, wherein the second particulate material is mixed by the other end of the mixing tool 7 than was used to mix the first particulate material. Different particulate materials may accordingly be mixed successively without changing the mixing tool 7.

I claim:

1. A method of mixing particulate materials in a mixing apparatus having a wall defining a mixing container and a mixing device mounted in said mixing container, said mixing device comprising a driving motor, a driven shaft connected to said motor and extending through said motor and extending through said container along the longitudinal axis thereof, comprising:

(a) placing a first particulate material in said mixing container;

(b) rotating said driven shaft in a first direction to mix said first particulate material, wherein radially extending arms are mounted on said shaft and having outer ends and mixing tools at said outer ends of said arms adapted to move round adjacent to said wall of said container in a plane of rotation, wherein each said mixing tool has a front end and a rear end, and at least on working flank provided on both said front and rear ends extends at an angle to said plane of rotation of said tool, said working flank at one of said ends of said tool extending at a different angle of inclination to said plane of rotation of said tool from said working flank at the other of said ends, said first particulate material being mixed by one of said ends;

(c) removing said first particulate material from said mixing container;

(d) placing a second particulate material in said mixing container, said second particulate material having a different internal fracture line from said first particulate material; and (e) rotating said driven shaft in a second direction, opposite said first direction, wherein said second particulate material is mixed by the other of said one of said ends, wherein different particulate materials may be mixed successively without changing said mixing tool.

* * * * *